United States Patent [19]

Oberst

[11] Patent Number: 4,623,259

[45] Date of Patent: Nov. 18, 1986

[54] TIDE TIMER

[76] Inventor: E. Ernest Oberst, 404 Patton Dr., Cheshire, Conn. 06510

[21] Appl. No.: 691,151

[22] Filed: Jan. 14, 1985

[51] Int. Cl.[4] ..... G04B 19/26

[52] U.S. Cl. ..... 368/19

[58] Field of Search ..... 368/19; 235/88 N, 88 R, 235/88 RC

[56] References Cited

U.S. PATENT DOCUMENTS

| | | | |
|---|---|---|---|
| 4,014,163 | 3/1977 | Wisser | 368/19 |
| 4,035,617 | 7/1977 | Banner | 235/88 N |
| 4,194,111 | 3/1980 | Katz | 235/88 R |
| 4,272,107 | 6/1981 | Elbow | 235/88 R |

FOREIGN PATENT DOCUMENTS

| | | | |
|---|---|---|---|
| 3301740 | 7/1984 | Fed. Rep. of Germany | 368/19 |

*Primary Examiner*—Bernard Roskoski

*Attorney, Agent, or Firm*—Walter Spruegel

[57] ABSTRACT

Tide timer providing a live imitation of the rising and falling water level during each tide, and affording an indication of the time to, and of the time of day or night of, the next high or low tide from observation of the water level on the timer alone, or by reading the time as indicated by a moving hand on a coordinated dial on the timer, or both.

19 Claims, 14 Drawing Figures

TIDE TIMER

This invention relates to tide timers in general, and to timers indicating every stage of each tide in particular.

Prior tide timers are mostly in the nature of a synchronized combination of solar and lunar time clocks in which driven hands characteristically indicate the passing solar and lunar time on coordinated dials, and the lunar times indicated denote everchanging times to the next high or low tide. While these prior tide timers are generally satisfactory, they are nevertheless open to criticism in a few, though important, respects. Thus, these prior timers are rather complex and accordingly costly, owing to the drives of their hands at solar and tide cycle rates and their time indications to the next high or low tides. Further, to obtain a desired indication of the day or night of the next high or low tide or of any phase therebetween, these timers not only have to be read rather attentatively, but even require some calculation, which in any event calls for some mental effort that may at times give rise to wrong tide information due to misreading or miscalculation, or both. Still further, even though these timers are in the nature of time clocks, their time indication is not nearly as obvious and unmistakable as is the time indication of time clocks, and even requires acquaintance and compliance with imperative instructions, preferably on the timers themselves, for correctly reading their time indications.

It is a primary object of the present invention to provide a tide timer of a type which at a mere glance and without any reading whatever affords an unmistakable indication of the approximate time to the next high or low tide and even of the approximate time of day or night of such next tide stage, thereby to obviate all the aforementioned functional criticisms of the prior timers. To this end, the present timer provides, and functions to give at any instant, an unmistakable live imitation of such a key factor as the increasing and decreasing depth of the water, and hence the rise and fall of the water level, of each tide at any given location for its established cycle time of 12 hours and 25½ minutes. Such imitation by the tide timer of the everchanging depth and level of the water between unmistakable high and low water level designations is particularly well suited to relate to the observer the time to the next high or low stage of a progressing tide, and even the approximate time of day or night of such next tide stage, for the actual time to the next high tide, for example, from the moment of observation of the water level on the timer, when rising, is for most, if not all, practical purposes sufficiently close to that proportion of one-half a solar time cycle, i.e., six hours, which the gap between the observed water level and the designated high water level on the timer bears to the overall distance between the designated high and low water levels, with such proportion being perceived by most any observer not only effortlessly and instantaneously, but also with fair accuracy. Thus, assuming that such an observation of the timer at the proper location for which it was set reveals a rising water level at approximately three-fourths of its maximum designated level, for example, this will instantaneously and unmistakably indicate to the observer that the time to the next high tide stage is approximately one-fourth of six hours, i.e., one and one-half hours. The time of day or night of this next tide stage will then also occur to the observer, if desired, by simply adding the exemplary one and one-half hour time to the presently observed clock time. For even greater facility and accuracy of the tide time indications afforded by the present timer, the imitation of the water depth and level indications of a tide may be provided with marks, preferably inscriptions, denoting prominent fractions of the span between the designated high and low water levels or directly denoting times to the next high or low stages of a tide.

It is another important object of the present invention to provide a tide timer of this type which is also of exceedingly simple construction and correspondingly low cost. Thus, the aforementioned live imitation of the water depth and level phases of a tide is provided by a transverse line in a longitudinal window in which the line moves at a substantially uniform rate alternately to the opposite ends of the window which conveniently constitute the designated high and low water levels of a tide and, hence, also signify high and low tide, respectively, with the line depicting at any instant not only the everchanging water level of a tide by its movement in the window, but also the rise or fall of the water level by the direction of movement of the line toward the respective high or low water level ends of the window, and the background in the window between its low water level end and the moving line therein being advantageously of sharply contrasting appearances, preferably colors, for increasing and decreasing water depth during a tide, to thereby gauge instantaneously at a mere glance not only the prevailing rise or fall of the water level, but also the next high or low stage of a tide from the particular color observed in the window. To these ends, the present timer has for its imperative operating elements merely a simple face plate in which the window is provided, a rotary tidal disk behind the face plate in which the line is simply inscribed, and an inexpensive timepiece which turns the disc at tide cycle rate, i.e., once during a tide time cycle of 12 hours and 25½ minutes for a 12 hour type timer, or once during two such tide time cycles for a 24 hour type timer. The tidal rise and fall of the water level on the timer is for all practical purposes adequately depicted by substantially uniform movement of the line in the window which may conveniently and advantageously be obtained quite readily by plotting its requisite outline on a disc while turning the same relative to a coordinated window. Thus, in the case of a 12 hour type timer, for example, the desired movement of the line in the window is obtained by the plotted outline on the tidal disc of a symmetrical figure of a simple heart on passage of this outline across the window during the drive of the disc on such coordination of the outline of the figure and window that the figure is exposed to view in the window over its full length along its axis of symmetry and is hidden from view behind the face plate in the respective high and low tide indications of the timer, and the figure is at all other times partly exposed in the window substantially as the water level changes during a tide. The aforementioned color contrast between rising and falling water level indications is obtained, in a timer of exemplary 12 hour type with the characteristic outline of a heart-like figure on its tidal disc, by applying contrasting colors to the disc inside the respective symmetrical lobes of the figure thereon when the low water level end of the window is nearest the rotary axis of the disc, and applying such contrasting colors to the disc outside the respective symmetrical lobes of the figure when the high water level end of the window is nearest the rotary axis of the disc.

It is a further important object of the present invention to provide a tide timer of this type which at any time affords also a readable indication of the time of day or night of the next high or low stage of any tide in progress, and thereby an also readable indication of the time to such next tide stage. To this end, the timer further provides a dial disc, a primary time mark and two hands, of which the dial disc is manually turnable about the rotary axis of the tidal disc and bears on its periphery hour graduations, from 1 to 12 in a 12 hour type timer, which are marked in progressive order in a direction opposite to the drive direction of the tidal disc, the primary time mark is provided on the face plate in line with the longitudinal axis of the window in association with one of the ends thereof, preferably the high water level end, and is also in time-reading relation with the graduations on the dial disc, and the hands are provided on the tidal disc in a 12 hour type timer in line with the axis of symmetry of the heart-like figure thereon and on opposite sides of the latter which are associated with high and low tide, with these hands being also in time-reading relation with the graduations on the dial disc and being preferably marked, such as "Hi" and "Lo" to indicate their association with high and low tide. Thus, to read the time of day or night of the next high or low stage of a tide in progress, it is merely necessary to turn the dial disc into position in which the primary time mark points at the present clock time on the dial disc as given by the graduations thereon, whereupon the time of day or night of the next high or low stage of the tide is directly pointed at on the dial disc by the corresponding hand on the tidal disc. Moreover, in thus setting the dial disc, the graduations thereon between the primary time mark on the face plate and either hand on the tidal disc afford a quick and unfailing indication of the time, in hours and fractions, to the next high or low tide stage.

It is a still further object of the present invention to provide a tide timer of this type which at any time today affords also a readable indication of the time of day or night of a high or low stage of a tide on a day subsequent to today, and thereby an also readable indication of the time to such high or low tide stage on such subsequent day. To this end, the face plate is provided with secondary time marks which progress from the primary time mark opposite to the drive direction of the tidal disc, and which are in time-reading relation with the graduations on the dial disc, and are spaced from each other and from the primary time mark by angular amounts equal to the time difference between successive high or low tides on subsequent days, with the successive second time marks away from the primary time mark being associated with successive days from the day associated with the primary time mark which is "today". Thus, in using the tide timer in the before described manner, the time of day or night of the tidal stages on a selected subsequent day can be determined by noting, today, the time on the dial disc opposite the secondary time mark for the selected day, and then turning the dial disc to bring this noted time indication thereon opposite the primary time mark, whereupon the times of such tidal stages on such selected day are then indicated by the corresponding hands on the tidal disc, with the times to such tidal stages on the selected day being then also indicated on the dial disc as explained above.

Further objects and advantages will appear to those skilled in the art from the following, considered in conjunction with the accompanying drawings.

Figure 1:
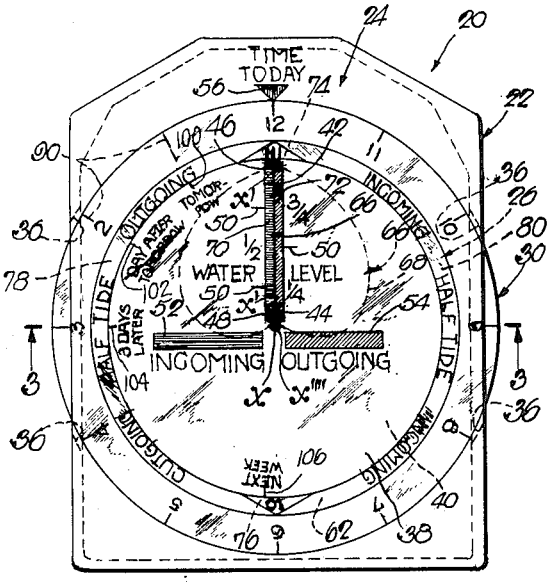
FIG. 1 is a front view of a tide timer which embodies the invention.
Figure 2:
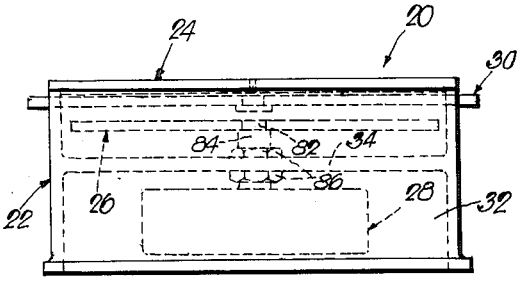
FIG. 2 is an elevational view of the same tide timer.

Referring to the drawings, and more particularly to FIGS. 1 to 9 thereof, the reference numeral 20 designates a tide timer which has for its major components a case 22, a face plate 24, a tidal disc 26, a timepiece 28, and a dial disc 30.

The case 22 is of preferably molded plastic, having an upright peripheral wall 32 and a transverse partition 34, with the case being initially open at its top, and the peripheral wall 32 having in its top diametrically opposite notches 36.

Figure 4:
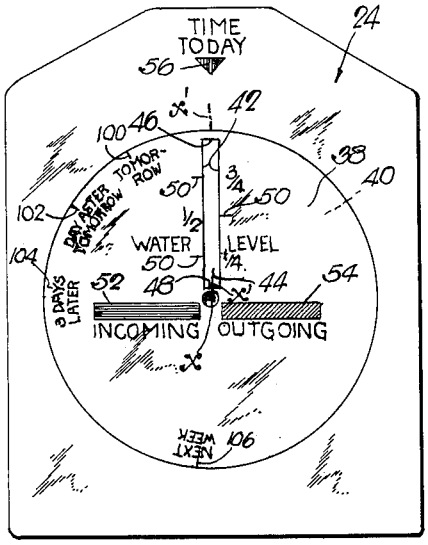
FIGS. 4, 5 and 6 are front views of different prominent parts of the tide timer.
Figure 5:
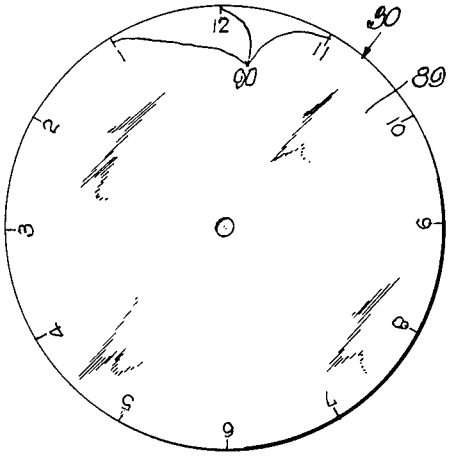

The face plate 24 may simply be formed of transparent plastic, with a central field 38 thereon being rendered opaque in any suitable manner, as by a pasted-on paper disc 40, for example (see also FIG. 4). The face plate 24 is provided within its opaque field 38 with a longitudinal window 42 which in this instance is formed by a rectangular slot 44 in the paper disc 40 to expose the transparent face plate within the confines of this slot, so that the window 42 is in this instance transparent. The window 42 is disposed to one side of the center axis x of the opaque field 38 on the face plate 24, and extends with its longitudinal axis x' radially of this field 38. The window 42 is provided for featured imitation therein with a line which moves to the opposite ends 46 and 48 of the window in a manner described hereinafter, with these opposite ends 46 and 48 of the window denoting to this end tidal high and low water levels, respectively, and hence also high and low tide, respectively, and the high water level end 46 of the window being in this instance spaced from the center axis x of the opaque field 38 farther than the low water level end 48. The opaque field 38 also bears graduations 50 and associated characters alongside the window 42, of which the characters express in this instance the spacing of the associated graduations 50 from the exemplary low water level end 48 of the window 42 in fractions of the overall length of the latter. For further explanation of the fractional characters 50 alongdide the window 42, the opaque field 38 bears in this instance also the legend "Water Level". The opaque field 38 on the face plate 24 is in this instance also provided with two rectangular fields 52 and 54 which within their confines have different appearances, and in this instance are marked in different and highly contrasting colors so that these fields 52 and 54 serve as color charts which are identified by nearby exemplary legends "Incoming"

and "Outgoing". Still further provided on the face plate 24 outside the window 42 is a mark 56 in the exemplary form of an arrowhead which is in line with the longitudinal axis x' of the window 42 and points at the center axis x of the opaque field 38 on the face plate 24, with this mark being spaced closer from the high water level end 46 of the window than from the other end 48 thereof. The mark 56 is preferably identified by the explanatory legend "Time Today".

Figure 6:
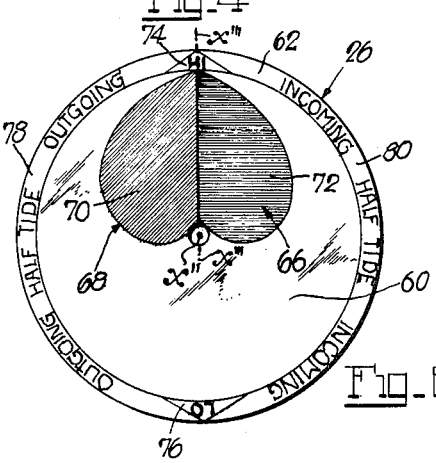
Figure 7:
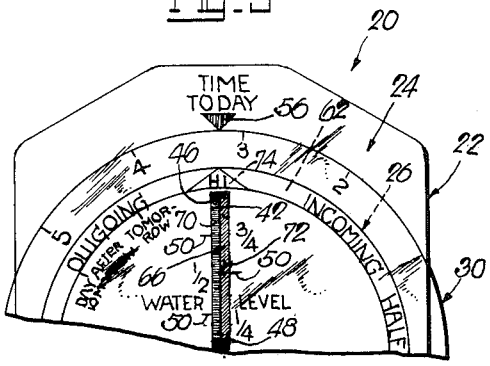
FIG. 7 is a partial front view of the tide timer in operation.

The tidal disc 26, which may be of any suitable transparent or opaque plastic, is divided into a central field 60 about the center axis x'' of the disc, and a surrounding peripheral field 62, of which the central field 60 is of the same size as the opaque field 38 on the face plate 24 (see also FIG. 6). The central field 60 of the tidal disc 26 bears a symmetrical figure 66, which forms part of the featured tidal water level imitation by the timer, is disposed to one side of the center axis x'' and extends with its axis of symmetry x''' radially of the disc 26, with the outline 68 of this figure being simply inscribed on the disc, and the symmetrical halves 70 and 72 of the figure being preferably marked in different colors, in this instance in the same colors as the charts 54 and 52, respectively, in the opaque field 38 on the face plate 24. The peripheral field 62 on the tidal disc 26 bears diametrically opposite hands 74 and 76 in the exemplary form of arrowheads which are aligned with the axis of symmetry x''' of the figure 66 and in this instance point away from the center axis x'' of the disc 26. The hands 74 and 76 are tide hands and associated with high and low tide by the respective explanatory legends "Hi" and "Lo" thereat. If desired, the symmetrical halves 78 and 80 of the peripheral field 62 on the disc 26 on opposite sides of the axis of symmetry x''' of the figure 66 may also bear diametrically opposite explanatory legends "Half Tide", "Incoming" and "Outgoing" at equi-angular spacing from each other and from the tide hands 74 and 76 and in the order shown in FIG. 6.

The timepiece 28, which is of lunar type, is conveniently operated by a replaceable battery (not shown) to drive its operating shaft 82 at a rate of one revolution per tide time cycle of 12 hours and 25½ minutes. The timepiece 28 further has a mounting sleeve 84 with nuts 86, an On-Off switch (not shown) for the battery, and an adjustment with a knob 88 which is turnable in either direction to adjust the operating shaft 82 and, hence, the tidal disc 26.

The dial disc 30 may be of any suitable transparent or opaque plastic. The same bears on its operative face 89 peripheral graduations, in this instance 12 hour graduations 90 for an exemplary 12 hour type timer, with these hour graduations 90 progressing, significantly, in counterclockwise direction (FIG. 5), i.e., counter to the exemplary clockwise drive direction of the tidal disc 26 as explained hereinafter.

Figure 3:
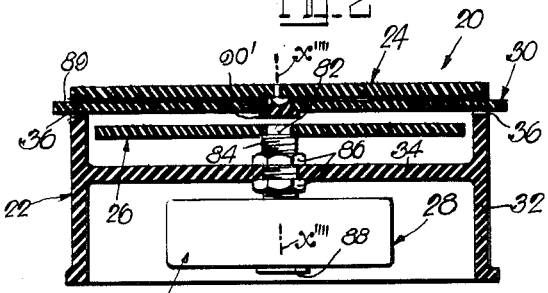
FIG. 3 is a section through the tide timer substantially along the line 3—3 of FIG. 1.

In assembling the described parts of the tide timer 20, the timepiece 28 is mounted in the partition 34 in the case 22 by means of the mounting sleeve 84 and nuts 86 in the manner shown in FIG. 3, whereupon the tidal disc 26 is passed into the case 22 through the open top thereof and mounted on the operating shaft 82 of the timepiece. The dial disc 30 may next be mounted for free rotation on a depending center stud 90 on the face plate 24 while the latter is still disassembled from the case 22, with the dial disc being disposed with its face 89 next to the face plate 24. The face plate 24 is finally assembled with the case 22 by being placed on top of the latter while the dial disc 30 is being led with its periphery into the opposite notches 36 in the top of the case (FIGS. 1 and 3), whereupon the face plate 24 is secured to the top of the case in any suitable manner, as by fusing, for example. The tide timer is now fully assembled, with all parts being centered on a common axis x'''' (FIGS. 1 and 3), and the dial disc 30 being manually turnable at its periphery where projecting to the outside of the case 22 at the top notches 36 in the latter.

For use of the tide timer at any desired locality, the same will first have to be set for that locality in accordance with the high or low tide times usually given for each day in the local newspaper or other publication. For example, if the tide timer is to be set on a particular day, this may conveniently and advantageously be done at high tide indication of the timer as in FIGS. 1 or 7, for example, while the timepiece 28 is stopped, and starting the timepiece into operation at its described switch at the time given for the next high tide on that same day. The tide timer is then set for the particular locality as long as the timepiece 28 continues to operate, no matter how long. For thus setting the tide timer advantageously at high tide indication, the same may in idle condition be readily adjusted from any tide indication to high tide indication by simply turning the knob 88 on the timepiece 28 in either direction to thereby turn the tidal disc 26 in a corresponding direction until the figure 66 thereon assumes the high tide position in FIG. 1 in which its axis of symmetry aligns with the longitudinal axis of the window 42 and the figure is fully exposed to view within the window. This means that in the tidal water level imitation in the window 42 the water level is at the high water level end 46 thereof to indicate not only a high water level but also a high tide. Of course, the tide timer may as advantageously be set according to the given time of the next low tide in low water level indication of the timer when the tidal disc 26 is displaced 180° from the position in FIG. 1 in which the figure 66 will appear not at all, or only slightly at the low water level end 48, in the window to indicate tidal low water level and also a low tide.

Another method to correct and set the timer for use at a particular locale's tide condition is to turn the dial disc 30 to conform to the user's present time at the "Time Today" mark 56, and then turn the adjustment knob 88 on the timepiece 28 in either direction to thereby turn the tidal disc 26 in a corresponding direction until the "Hi" tide hand 74 or the "Lo" tide hand 76 on the tidal disc 26 is opposite the same time indicated on the dial disc 30 as set forth in the newspaper or other publication.

Figure 8:
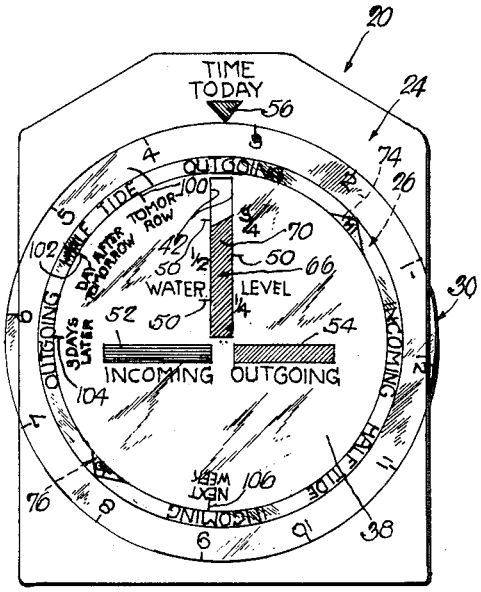
FIGS. 8 and 9 are front views of the tide timer in operation and indicating different tide stages.
Figure 9:
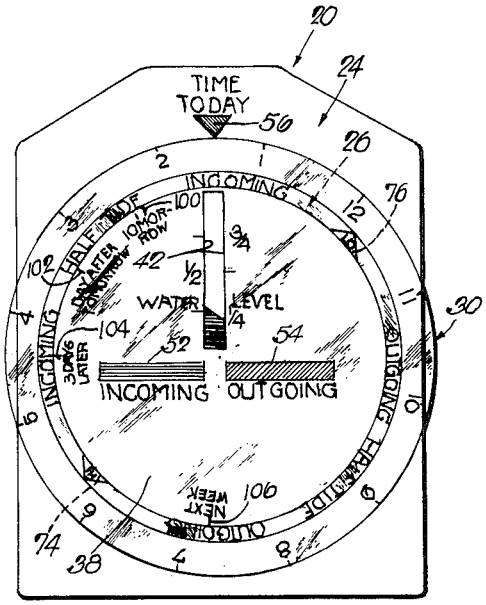

In operation of the tide timer, the outline 68 of the symmetrical figure on the tidal disc 26 is to indicate the rise and fall of the water level during a tide by its movement in the window 42 as it appears to an observer. To this end, the outline 68 of the figure 66 on the tidal disc 26 may simply be a copy of a master outline which has been obtained quite readily and most accurately by plotting so that this outline moves at a uniform rate in the window from one end to the other end and back to the one end on the passage of this outline across the window on the uniform drive of the tidal disc through one revolution, i.e., during a tide time cycle of 12 hours and 25½ minutes. The outline thus obtained simulates that of a heart. Thus, in the course of each tide the stage thereof at any instant is indicated by the observed water level in the window 42, such as the exemplary water level in FIG. 8 which appears at approximately three-fourths height according to the fractional level graduations 50 along the window. With the drive direction of the tidal disc 26 being in this instance clockwise in FIGS. 1,7,8 and 9, the exemplary three-fourths height water level indicated in the window 42 in FIG. 8 is that of a falling water level, as is evidenced not only by the clockwise passage of the "Hi" tide hand 74 beyond the "Time Today" mark 56, but also by the particular color appearance in the window 42 of that symmetrical half of the figure 66 which according to the color chart 54 on the face plate 24 designates an outgoing tide or falling water level. Accordingly, with the exemplary water level in FIG. 8 being at three-fourths heightand falling, this water level alone will indicate that the next low tide will occur in three-fourths of one-half tide time cycle, but for most, if not all, practical purposes it is sufficiently close to mentally calculate the next low tide instantaneously and quite easily as occurring in three-fourths of one-half 12 hour cycle, i.e., 4½ hours, and mentally to calculate just as easily and quickly the clock time of this next low tide as 4½ hours from the present clock time. Thus, if the present clock time were 3.18 PM, for example, the clock time of this next low tide would be 3.18 plus 4.30 or 7.48 PM. This exemplary clock time of the next low tide is also directly readable on the dial disc 30. Thus, on manually setting the dial disc 30 to bring the present clock time of 3.18 thereon into register with the "Time Today" mark 56, as in FIG. 8, the "Lo" tide hand 76 on the tidal disc 26 will then point directly at 7.48 on the dial disc 30, just as it does in FIG. 8. The dial disc 26 may also serve for direct reading of the dock time of a past high or low tide. Thus, at the exemplary tide indication by the timer in FIG. 8, the clock time on the dial disc 30 of the last high tide is pointed at by the "Hi" tide hand 74, which in this instance is 1.48.

The dial disc 30 may also be called upon to assist in setting the tide timer. Thus, with the idle tide timer being set with its tidal disc 26 to indicate an exemplary high tide as in FIG. 7, and the next official high tide for today is given as 3.18 PM, for example, the dial disc 30 may prior to 3.18 PM on that day be manually set to be with its 3.18 time indication in register with the "Time Today" mark 56, as in FIG. 7, so that it is merely necessary to follow the dictates of the dial disc to start the drive of the tidal disc at the actual clock time of 3.18 on that same day.

The face plate further bears within its opaque field 38 peripheral marks 100,102,104 and 106 which are secondary time marks for subsequent days and are to this end marked with the explanatory legends "Tomorrow", "Day After Tomorrow", "3 Days Later" and "Next Week". These marks 100 to 106 are progressing counterclockwise from the "Time Today" or primary time mark 56, and these secondary time marks 100, 102 and 104 are angularly spaced from each other and from the primary time mark 56 by an angular distance which represents the difference in time between high or low tides on succeeding days, and the "Next Week" mark 106 is correspondingly further spaced from the primary time mark 56, as will be readily understood. Thus, in the exemplary tide indication by the timer in FIG. 9, the tidal disc 26 is shown in its position at today's exemplary clock time of 1.28 PM. If it is now desired to obtain from the timer the clock time of the high tide, for instance, that occurs after 1.28 PM tomorrow, for instance, it is merely necessary to read on the dial disc 30 the time that is in register with the "Tomorrow" mark 100, which is 2.19, whereupon the dial disc 30 is turned clockwise to bring the 2.19 time indication thereon into register with the primary time mark 56, and the "Hi" tide hand 74 will then point at tomorrow's clock time on the dial disc of this next high tide tomorrow, which in this example would be 6.38. The other marks 102 to 106 may be used similarly as the mark 100 to obtain the clock times of tides on still other subsequent days.

Figure 10:
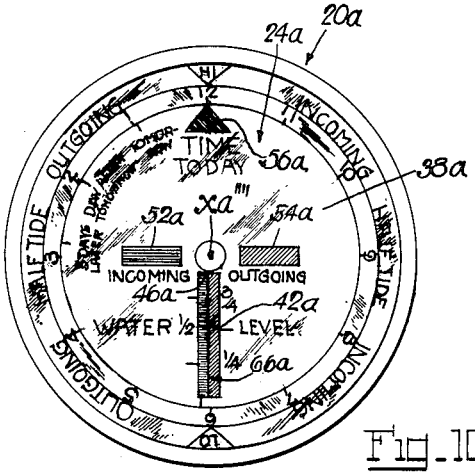
FIG. 10 is a front view of a tide timer which embodies the invention in a modified manner.
Figure 11:
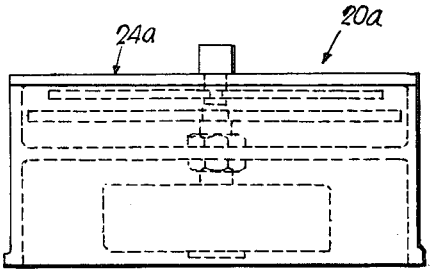
FIG. 11 is an elevational view of the modified tide timer of FIG. 10.
Figure 12:
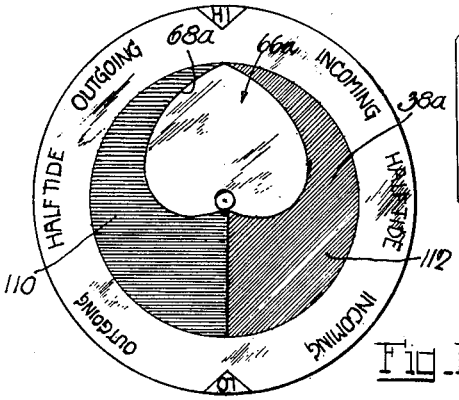
FIG. 12 is a front view of a prominent operating part of the modified tide timer.

Reference is now had to FIGS. 10 and 11 which show a modified tide timer **20*a* that is in most respects like the tide timer 20, except that the face plate is a circular disc 24*a* which leaves the entire timer of convenient circular outline. To this end, the "Time Today" mark 56*a* has been disposed inside the opaque field 28*a* on the face plate 24*a*, and the transparent window 42*a* is disposed with its high water level end 46*a* next to the common axis xa'''' of the timer. The different disposition of the window 42*a* requires a different arrangement of the heart-stimulating figure 66*a* in the manner shown in FIG. 12 in which the symmetrical halves 110 and 112 of the opaque field 38*a* outside the outline 68*a* of the figure 66*a* are marked in the different colors of the respective charts 52*a* and 54*a* on the face plate 24*a*. It is believed that the operation of this modified tide timer 20*a* is fully understood in view of the description of the tide timer 20 in FIG. 1**.

Figure 13:
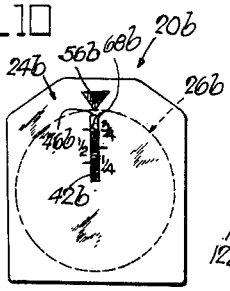
FIG. 13 is a front view of a tide timer embodying the invention in a further modified manner.

Reference is now had to FIG. 13 which shows a further modified tide timer **20*b* of exceeding simplicity. This tide timer 20*b* features the live imitation of the rising and falling water level of successive tides, but lacks most of the other functional and structural features of the tide timer 20 of FIG. 1. The live imitation of the rising and falling water level of successive tides is achieved in this modified timer 20*b* by the outline 68*b* of a heart-simulating figure on a tidal disc 26*b* on its passage across a transparent window 42*b* in a face plate 24*b* on the drive of the tidal disc at a uniform rate of one revolution per tide time cycle. The face plate 24*b* preferably bears a "Time Today" mark 56*b* which is associated with the high water level end 46*b* of the window 42*b* and, hence, also with high tide. Thus, the stage at any time of a tide is indicated at a mere glance by the live water level in the window 42*b*, and approximate times to, as well as approximate clock times of, particular stages of a tide in progress may quite readily and quickly be calculated in an observer's mind as explained earlier in connection with the tide timer 20 of FIG. 1**.

Figure 14:
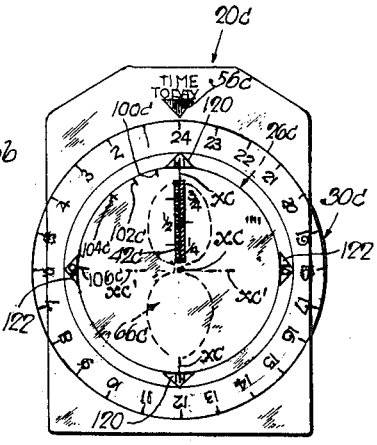
FIG. 14 is a front view of a tide timer embodying the invention in a still further modified manner.

Reference is finally had to FIG. 14 which shows a 24 hour type tide timer **20*c*** that also embodies the invention. Thus, this 24 hour type tide timer 20*c* may in all respects be like the tide timer 20 of FIG. 1, except that the dial disc **30*c* has 24 hour graduations, and the tidal disc 26*c* has two pairs of diametrically opposite tide hands 120 and 122 on axes normal to each other and intersecting the center axis xc'''' of the timer, of which the hands of the pair 120 denote in this instance "Hi" tide hands and the hands of the other pair denote "Lo" tide hands. Further, to obtain in the window 42*c* the stages of two tides during 24 hours, the tidal disc 26*c* is driven at a uniform rate of one revolution per two tide time cycles of 12 hours and 25½ minutes each, and the figure 66*c* on this tidal disc has symmetrical halves about two axes of symmetry xc and xc' which are normal to each other and intersect the center axis xc'''' of the timer. Further, the subsequent day marks 100*c*,102*c*, 104*c* and 106*c* are angularly spaced from each other and from the "Time Today" mark 56*c* at distances which are half of those in the tide timer 20 of FIG. 1. It is believed that the operation of this 24 hour type tide timer is fully understood in view of the earlier description of the operation of the timer 20 of FIG. 1**.

It is to be noted that the tide timers 20,20*a* and 20*c* illustrated in FIGS. 1, 10 and 14 and described herein have a timepiece which causes the tidal discs 26, 26*a* and 26*c* to rotate in an exemplary clockwise direction, wherefore the dial discs 30,30*a* and 30*c* and the secondary time marks on the face plates 24,24*a* and 24*c* are thusly required to have, and are shown to have, hour and day graduations which are marked in progressive order in a counterclockwise direction.

What is claimed is:

1. A tide timer, providing a case, a tidal disc mounted in said case for rotation about its center axis, a timepiece for driving said disc at a uniform rate of one revolution during a whole number of tide time cycles, a face plate on said case in cover relation with said disc and having a longitudinal window with opposite ends denoting high and low water levels, respectively, with said window being disposed to one side of said center axis and extending lengthwise radially of said disc, and said disc bearing a symmetrical figure of an outline plotted to appear in said window as a rising and falling water level moving therein at a substantially uniform rate from one end to the other end and back to the one end thereof on its passage across said window on the drive of said disc during each of successive tide time cycles.

2. A tide timer as in claim 1, in which said number is 1.

3. A tide timer as in claim 2, in which said number is 2.

4. A tide timer as in claim 1, in which said number is 1, and said figure simulates a heart.

5. A tide timer as in claim 1, in which said number is 2, and said figure has symmetrical halves about axes normal to each other and intersecting said center axis.

6. A tide timer as in claim 1, in which said high water level end of said window is spaced farther from said center axis than the other end, and the symmetrical halves of said figure bounded by the halves of said outline depicting rising and falling water levels, respectively, in said window have different appearances, whereby to gauge the rise and fall of the water level and the high and low water level designations of the ends of the window by the respective appearances of said figure halves in the window.

7. A tide timer as in claim 1, in which said high water level end of said window is spaced closer from said center axis than the other end, and said disc has different appearances outside the parts of said outline which depict rising and falling water levels, respectively, in said window, whereby to gauge the rise and fall of the water level and the high and low water level designations of the ends of the window by the respective appearances of said disc in the window.

8. A tide timer as in claim 6, in which said different appearances of said figure halves are those of contrasting colors.

9. A tide timer as in claim 7, in which said different appearances of said disc are those of contrasting colors.

10. A tide timer as in claim 1, in which said face plate bears graduations along said window at selected spacing from the ends thereof and from each other to gauge from said graduations the approximate time to any desired stage of a tide in progress.

11. A tide timer as in claim 10, in which said graduations are marked to express their respective spacing from one end of said window in fractions of the length of said window.

12. A tide timer as in claim 4, in which said disc bears diametrically opposite hands in line with the axis of symmetry of said figure, of which the hand nearest said high water level end of the window at high water level indication by said figure outline in said window denotes high tide and the other hand denotes low tide, whereby the approximate time to a selected stage of a tide is gaugeable from either hand by its present angular position or from the present indicated water level in said window.

13. A tide timer as in claim 5, in which said disc bears two pairs of diametrically opposite hands in line with said axes of symmetry, respectively, of which the diametrically opposite hands of one pair nearest said high water level end of the window at successive high water level indications by said figure outline in said window denote high tide and the hands of the other pair denote low tide, whereby the approximate time to a selected stage of a tide is gaugeable from any hand by its present angular position or from the present indicated water level in said window.

14. A tide timer as in claim 12, in which said window has a longitudinal axis, and which further provides a 12 hour dial disc manually turnable about said center axis and bearing peripheral time graduations progressing opposite to the drive direction of said tidal disc, whereby the approximate clock time of the nect high or low tide is pointed at on said dial disc by the corresponding tide hand on setting said dial disc to bring the present clock time thereon into alignment with said window axis outside of said window and adjacent to said high water level end thereof.

15. A tide timer as in claim 14, which further provides a primary time hand on said face plate in lengthwise alignment with said axis of said window and spaced from the latter outwardly from said high water level end thereof, and said dial disc being set with its indication of the present clock time in line with said time hand.

16. A tide timer as in claim 13, in which said window has a longitudinal axis, and which further provides a 24 hour dial disc manually turnable about said center axis and bearing peripheral time graduations progressing opposite to the drive direction of said tidal disc, whereby the approximate clock time of the next high or low tide is pointed at on said dial disc by the corresponding tide hand on setting said dial disc to bring the present clock time thereon into alignment with said window axis outside of said window and adjacent to said high water level end thereof.

17. A tide timer as in claim 16, which further provides a primary time hand on said face plate in lengthwise alignment with said axis of said window and spaced from the latter outwardly from said high water level end thereof, and said dial disc being set with its indication of the present clock time in line with said time hand.

18. A tide timer as in claim 15, which further provides a secondary time hand on said face plate angularly spaced from said primary time hand in said opposite direction by an angular distance which on said dial disc corresponds to the difference in clock time between identical tides on successive days, thereby to permit the reading on the dial disc today of the approximate clock time of a next high or low tide tomorrow by the corresponding tide hand.

19. A tide timer as in claim 17, which further provides a secondary time hand on said face plate angularly spaced from said primary time hand in said opposite direction by a distance which on said dial disc corresponds to the difference in clock time between identical tides on succeeding days, thereby to permit the reading on the dial disc today of the approximate clock time of a next high or low tide tomorrow by the corresponding tide hand.

* * * * *